US005934504A

United States Patent [19]

Elliott

[11] Patent Number: 5,934,504

[45] Date of Patent: Aug. 10, 1999

[54] DEVICE FOR DISPENSING PREFORMED TABS FROM A ROLL TO AN AUTOMATIC NAIL GUN

[76] Inventor: David W. Elliott, 1620 Hamilton St., Eustis, Fla. 32726

[21] Appl. No.: 08/911,241

[22] Filed: Aug. 15, 1997

[51] Int. Cl.[6] ..... B65H 1/08

[52] U.S. Cl. ..... 221/232; 221/238

[58] Field of Search ..... 221/232, 238, 221/239, 268, 269, 270; 411/160, 162, 164; 227/38, 39, 136, 138

[56] References Cited

U.S. PATENT DOCUMENTS 5,184,752 2/1993 Zylka et al. ..... 221/1

5,339,983 8/1994 Caple ..... 221/238

*Primary Examiner*—Kenneth Noland

*Attorney, Agent, or Firm*—Julian C. Renfro, Esq.

[57] ABSTRACT

A device utilized in conjunction with an automatic nail gun for dispensing preformed tabs from a roll to a location adjacent where nailing is to take place, this device comprising a housing having an upper portion, front and back portions, and a lower member. The lower member is adapted to be brought into close proximity with a surface upon which nailing is to take place. The housing also has components for removably securing the housing in an operative relationship adjacent the automatic nail gun. An inner chamber is defined in a mid portion of the housing, in which chamber a roll of preformed tabs is contained, with an opening being provided through which the end of the roll of tabs is to move under the portion of the adjacent nail gun at which nailing is to take place. An actuating lever is rotatably mounted on the housing and is operably connected with a tab advancement device. This lever is movable so as to cause a controlled motion of the end of the roll of tabs such that a tab at the end of the roll is selectively moved through the opening to a location under the portion of the nail gun directly concerned with nailing.

20 Claims, 6 Drawing Sheets

DEVICE FOR DISPENSING PREFORMED TABS FROM A ROLL TO AN AUTOMATIC NAIL GUN

BACKGROUND OF THE INVENTION

The present invention relates to a novel tab dispensing device utilized with a pneumatically or electrically powered nail gun or staple gun for providing a tab positioned to properly receive a nail or staple delivered by the gun.

Automatic staple or nail guns, powered by electricity or air pressure, are frequently utilized to staple or nail tar paper or other roofing material onto the roofs of homes and buildings. Local building codes now permit the use of wide crown staples and pneumatically driven nails to attach the tar paper or roofing material to the plywood structure of the roof. However, the staples or nails must be used in conjunction with very thin metallic or plastic tabs or discs. Essentially, each nail or staple is driven through these tabs or discs such that the upper part of the inverted U-shaped staple, or the head of the nail, remains in contact with the disc or tab surface while the legs of the staple or the shank of the nail protrude through the tab, through the tar paper or other generally waterproof building cover, and into the underlying plywood or other type of solid roof structure.

It was customary in the past for a roofer to grasp a single disc, place the disc in the appropriate location on the roof, position the powered automatic staple gun or nail gun above the disc, and then trigger the gun, to cause the expulsion of the staple or nail. The staple or nail, driven by a significantly large force, penetrates the tab or disc and the tar paper and is injected into the underlying solid roof structure. This procedure can be dangerous in that the roofers must manually handle the discs and accurately place the gun atop the disc before firing the gun. There is a possibility that the roofer may be injured by not withdrawing his or her hand from the disc prior to firing the staple or nail. Misplacement of the gun or staple or nail on top of the disc or tab requires that the roofer repeat the procedure to properly place the staple or nail in the central region of the tab or disc. Typically, several thousand staples or nails and discs are utilized on a single residential roof.

An advance in the feeding of tabs or discs to a nail gun is represented by the Zylka et al Pat. No. 5,184,752 entitled "METHOD AND APPARATUS FOR FEEDING TABS OR DISCS TO AN AUTOMATIC STAPLE OR NAIL GUN," which patent issued Feb. 9, 1993. In accordance with that device, a preformed dimpled disc is dispensed from a stack of discs as the result of a co-functioning of the Zylka et al device with the nail gun. However, the arrangement taught by Zylka et al necessitated to some extent, an alteration of the safety features provided by the manufacturer of the nail gun. In addition, the interconnection between the Zylka et al device and the nail gun adversely affects the mobility of the nail gun.

In comparison with the Zylka et al device, the instant device is not directly connected in any physical way with the safety features inherent to the nail gun, thus avoiding any compromise of the safety features relied upon by the nail gun manufacturer.

Quite significantly, the Zylka et al device requires power from an outside source, either pneumatic or electric, which involves a definite amount of setup time as well as additional expense. In contrast, only the nail gun itself, rather than the instant invention, involves the need for the application of external power.

The circular tabs utilized in the field by Zylka et al are utilized in a stacked relationship in a cylindrically shaped canister or container. Because the tabs are quite thin, the discs are rather difficult for the Zylka et al type device to separate. In attempting to overcome the problems involved in separating these thin individual tabs from the stack, Zylka et al dimpled their tabs. The dimples allow for clearance between tabs so that their shuttle device can remove one tab at a time from the stack. The dimpling process likely requires a relatively high degree of accuracy in order that the correct tolerances can be maintained. Because the instant device uses a completely different tab moving procedure, it can utilize tabs made with a wide margin of tolerance and without the need for dimpling.

The build-up of dirt and grime on exposed tool components is common in the work environment. Because of the close tolerances needed between tabs in the Zylka et al device, it is much more susceptible to the build-up of dirt and grime than would the instant device.

The tabs used by both Zylka et al and the instant invention are waterproof. However, the tabs utilized by Zylka et al are packaged in disposable cardboard canisters which are prone to damage due to hazards of the work environment such as moisture or dropping. The instant device uses a single rubber band to keep the waterproof tab strip in a packaged roll form until the time of actual use.

It is further to be noted that Zylka et al's device entails it being pushed or rolled across a nailing surface, placing the user of such device at a distinct disadvantage if he was working on a surface other than horizontal. The safety spring used on the nail gun is normally not strong enough to move the two devices apart, which causes the operator to have to pull the nail gun away from the tab device in order to cause both devices to operate. This is to be contrasted with the instant invention, which is designed to operate in a highly satisfactory manner through all positions, whether horizontal, vertical or inverted.

Other comparisons of the instant device with Zylka et al will become more apparent as the description proceeds.

SUMMARY OF THE INVENTION

A device in accordance with this invention is intended to be utilized in conjunction with an automatic nail gun, for dispensing preformed tabs from a roll to a location adjacent where nailing occurs. My novel device comprises a housing, with the housing having an upper portion from which the device may be carried, and a lower member adapted to be brought into close proximity with a surface upon which nailing is to take place. The housing also has front and rear portions, with mounting means on the front portion for removable attachment to an automatic nail gun to which preformed tabs are to be provided.

An inner chamber is located in a mid portion of the housing, and in this chamber a roll of preformed tabs is contained, with an opening disposed adjacent a location where the lower member joins the front portion of the housing. Through this opening the end of the roll of tabs is to be dispensed and to move under the safety member of the nail gun.

No external motive power is involved, with the feeding of tabs from the roll of tabs being accomplished by the use of an actuating lever rotatably mounted on a rear lower part of the housing, with a lower component of the lever extending under the lower member of the housing. The lever is movable from an inactive position in which the lower component of the lever has pivoted away from the lower member, into an active position in which the lower component of the lever is substantially contiguous to the lower member. The lever is operably connected with tab advancement means such that movement of the lever from the inactive position into the active position causes a controlled motion of the end of the roll of tabs, such that one of the tabs at the end of the roll is moved to a location under the safety member of the nail gun. In the preferred embodiment of this invention, cutting means are advantageously provided for severing a selected first tab away from the roll of tabs whereby when the nail gun has been operated, a nail will be driven through the severed tab and into the surface upon which nailing is to take place.

It is therefore an object of the present invention to provide a vastly improved device of non-complex construction for semi-automatically feeding a tab to a location below the part of an associated nail gun from which a nail is to emerge, thus to eliminate the requirement that the roofer individually handle the tabs or discs through which a nail is to be driven.

It is another object of this invention to provide a device that will semi-automatically dispense individual tabs from a roll of preformed tabs, with this being accomplished without any need for external power and without compromising any aspect of the operation of the associated nail gun.

It is yet another object of this invention to provide a device providing individual tabs on an as-needed basis to the location at which a nailing function is to be carried out, with this involving no requirement for external power and with any need for preformed, dimpled discs being entirely eliminated.

It is still another object of this invention to provide a readily affordable tab dispensing device that can be quickly attached to or removed from a nail gun, with the feeding of tabs from the dispensing device to a location below the active portion of the nail gun taking place in a carefully timed relationship to the driving of nails by the nail gun, with this feeding of tabs requiring no power from the nail gun nor any alteration of the safety features of the nail gun.

It is yet still another object of this invention to provide a tab dispensing device of all mechanical construction that is readily adaptable for use with conventional nail guns or staple guns, and that semi-automatically provides a tab under the active portion of the associated nail gun or staple gun each time the device is placed in a new position on the work surface.

It is yet another object of this invention to provide tabs connected edge to edge by a narrow strip of similar or non-similar material and wound into a roll that can be readily inserted into the instant tab dispensing device for supplying individual tabs on an as-needed basis to an adjacent nail gun or staple gun.

These and other objects, features and advantages will be more apparent from the appended drawings.

DETAILED DESCRIPTION

Figure 1:
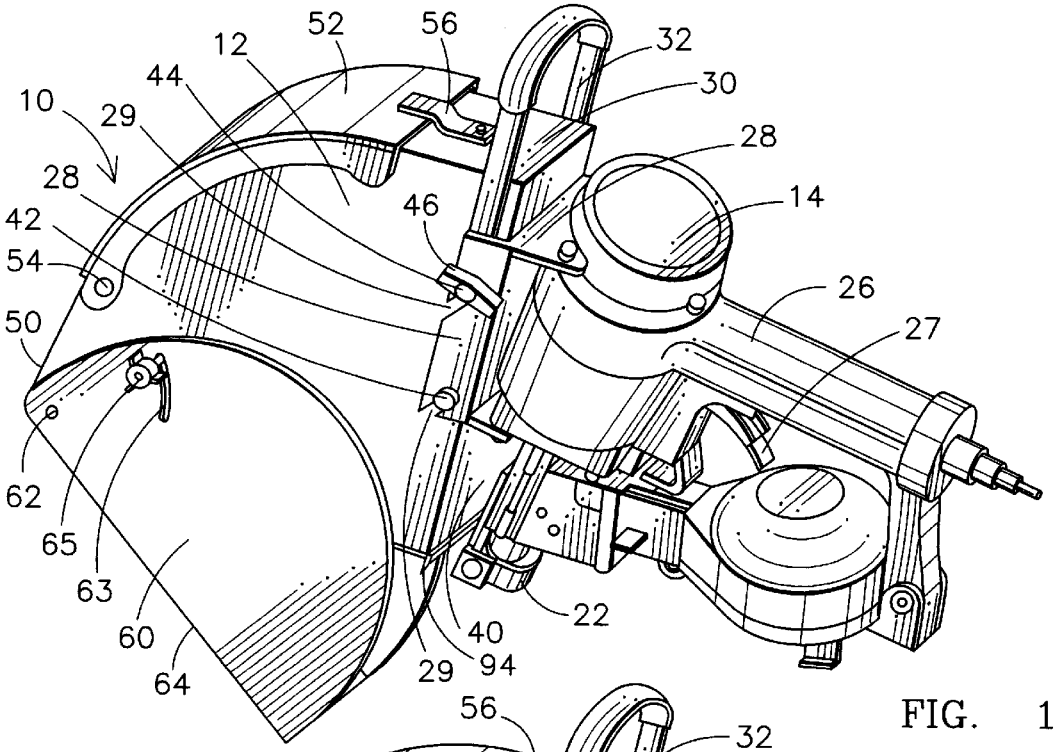
FIG. 1 is an overall perspective view of a tab dispensing device in accordance with this invention, with my novel device depicted in an attached relationship to a commercially available nail gun.

With initial reference to FIG. 1 it may be seen that I have depicted my novel tab dispensing device 10 involving a housing 12 that is to be removably affixed to, and used in conjunction with, an automatic nail gun 14 that is equipped with a strip of nails. As will be explained at length hereinafter, it is the principal purpose of the instant invention to provide an arrangement for furnishing a new tab or disc to be penetrated by a nail each time a nail is to be driven by the gun 14 into a surface upon which nailing is to take place.

Figure 2:
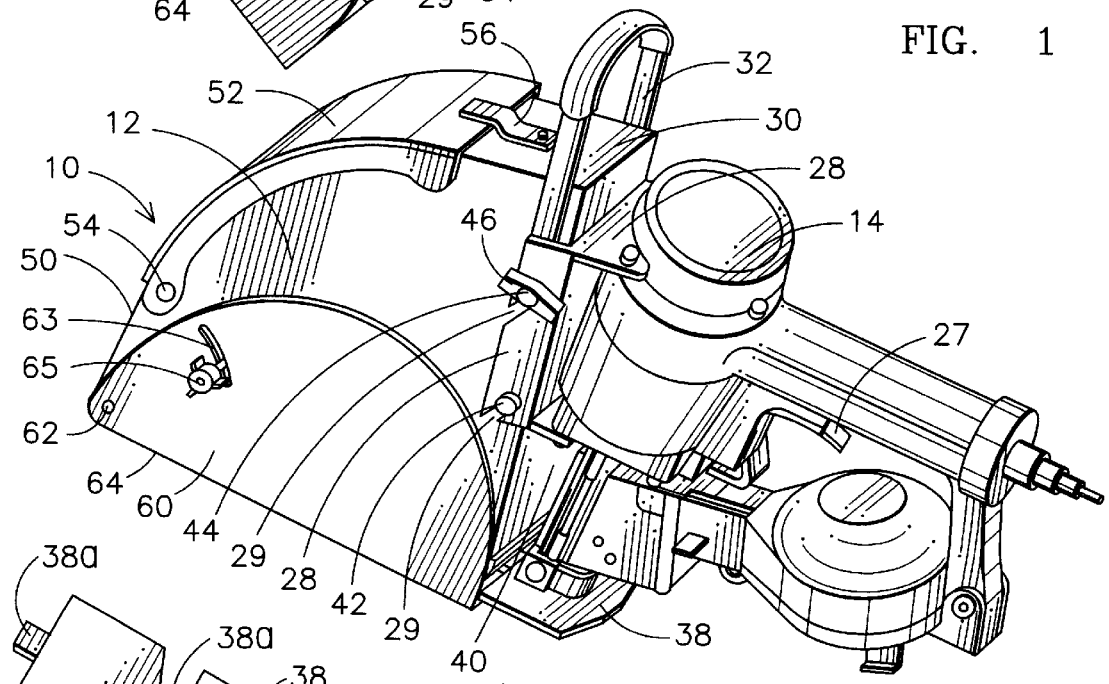
FIG. 2 is a view similar to FIG. 1 but here showing how by the functioning of my novel tab dispensing device, a tab emerges from the front of my device at a location directly below the place where nailing is to occur.

The nail gun 14 depicted in FIGS. 1 and 2 is intended to denote a generic type gun, either electrically powered or pneumatically powered, and able to drive nails or staples, as the case may be, into a suitable surface. It is important to note that none of the details of the nail gun 14 form an intrinsic part of the instant invention.

Figure 8:
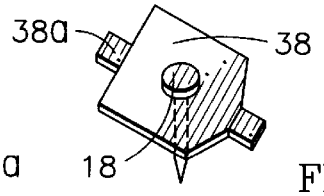
FIG. 8 is a view showing how a nail is driven through the approximate centerpoint of a tab dispensed by operation of my novel device.
Figure 3:
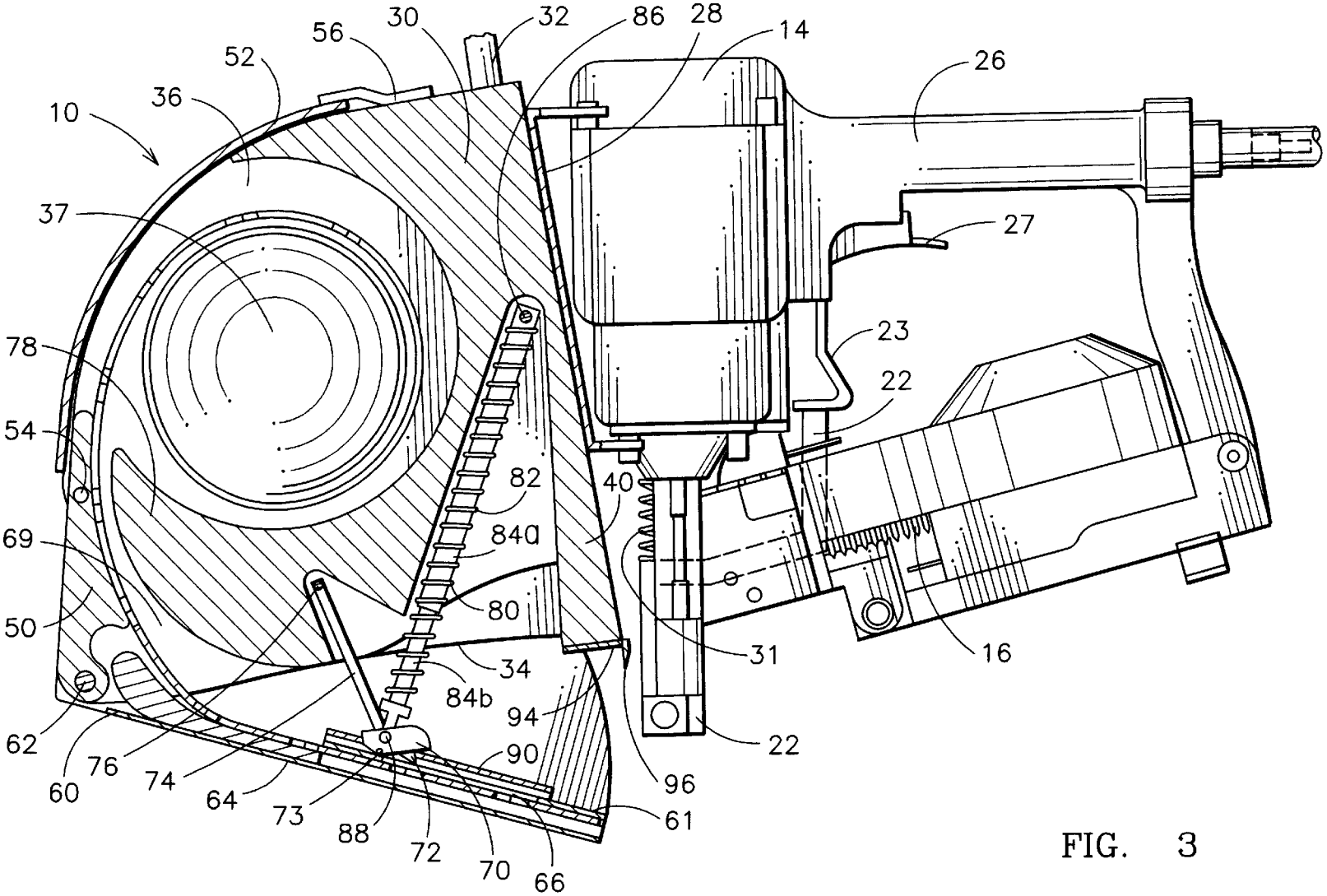
FIG. 3 is a cross sectional view of my device to a larger scale in order to show important details of the construction enabling tabs to be semi-automatically dispensed in such a manner as to receive a nail driven by the adjacent nail gun.
Figure 4:
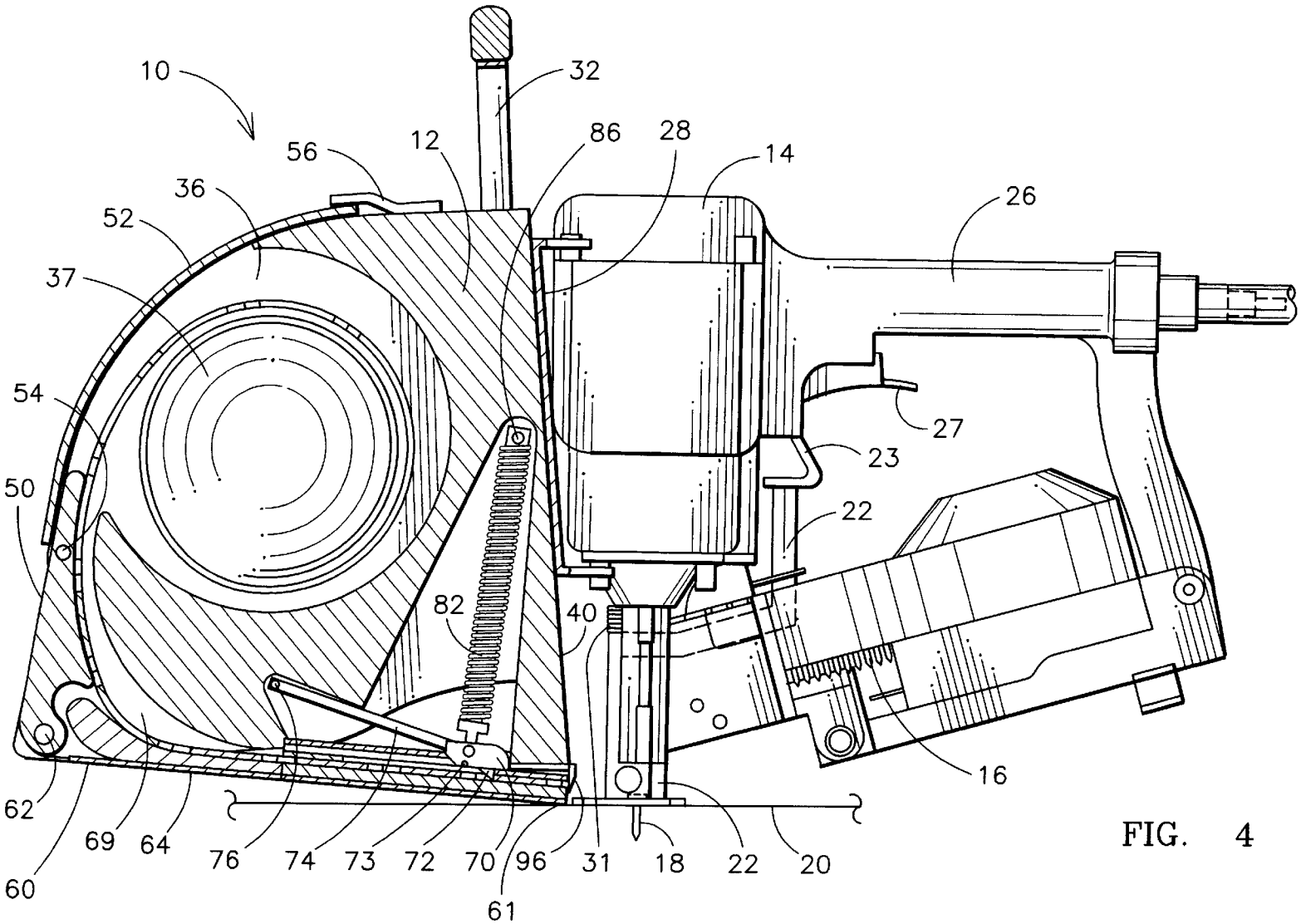
FIG. 4 is a cross sectional view similar to FIG. 3 but here showing how the movement of the pivotally disposed actuating lever operatively mounted on the underside of my tab dispensing device has caused a single tab to be dispensed in a desired relationship to the location where the nail is to be driven by the adjacent nail gun.

With brief reference to FIGS. 3 and 4 it can be seen that an exemplary strip of nails 16 is shown in an operative position on the nail gun 14, with it to be understood that a single nail 18, visible in FIGS. 4 and 8, is driven into the nailing surface 20 at such time as the lower end of the gun safety member 22 has been brought into firm contact with the nailing surface 20 and the trigger 27 has been pulled. The gun safety member 22 is upwardly slidable and somewhat of a "Z" shaped configuration, with its lower end able to be brought into contact with the surface into which the nail is to be driven, and its upper end in operative contact with the upwardly slidable safety component 23. Spring 31 depicted in FIG. 3 is a compression spring that provides a downward bias to the gun safety member 22. The spring 31 forms an intrinsic part of the nail gun 14, which spring must be overcome each time the user pushes down on the handle 26 so that the driving of a nail can be accomplished.

It is therefore to be understood that in accordance with the design of the nail gun 14, a nail cannot be fired until downward pressure to overcome the spring 31 has been applied to the handle 26 by the operator, to bring about the upward motion of the safety component 23 such that the operator will be able to pull the trigger 27 and thus accomplish the driving of the nail 18 in the selected location.

In order to enable my novel device 10 to be readily affixed to the nail gun, I prefer to attach a mounting component 28 in what may be a permanent manner onto the outer surface of the nail gun 14, as will be noted in FIGS. 1 through 4. The presence of the mounting component 28 does not in any manner affect the intended use of the nail gun, whether or not the nail gun is being used in conjunction with my novel tab dispensing device 10. The manner in which the housing 12 of the device 10 is attached to the mounting component 28 will be discussed shortly.

The novel tab dispensing device 10 forming the subject matter of this invention is principally constituted by the aforementioned housing 12 from which individual preformed tabs can be dispensed from a strip of consistently spaced tabs to a location under the portion of the nail gun directly concerned with nailing, with this being accomplished in a carefully integrated relationship with the operation of the nail gun. The housing 12 has an upper portion and a lower member, with the upper portion 30 equipped with a supporting member or handle 32 clearly visible in FIGS. 1 and 2, which handle is positioned to facilitate the easy movement of the tab dispensing device 10 from place to place. The lower member 34 of the housing 12 is clearly visible in FIG. 3. With reference to FIG. 4, it is to be understood that the lower member 34 of the housing is intended to be brought into a close relationship to the nailing surface 20. The surface 20 will hereinafter be referred to as the surface upon which nailing is to take place.

Contained in the midportion of the housing 12, as best seen in FIGS. 3 and 4, is the cavity 36 in which a roll 37 of consistently spaced, preformed tabs is contained. The preferred type of tabs involves the use of a tough plastic constructional material such as high impact polystyrene, but obviously I am not to be limited to this material. With reference to FIGS. 7 through 10, it will be noted that each individual tab 38 of the roll of tabs is essentially identical and generally rectangularly configured, with the tabs being disposed on a relatively narrow strip 38*a* in a consistently spaced relationship. Typically the front edge of each tab is rounded or angled in the general manner illustrated in these four figures.

As an alternative to all-plastic construction, the roll of tabs could be made up of individual, relatively thin metal tabs secured in a consistently spaced relationship to a relatively narrow continuous strip, such as a strip of an industrial grade plastic.

A particularly important part of my invention is involved in the provision of an actuating lever or arm member 60, revealed in some detail in FIGS. 1 and 2, but in greater detail in FIGS. 3 and 4. The lever 60 is generally U-shaped in cross section, with the lever being operatively mounted in a pivotal manner adjacent the lower member 34 of the housing 12. The generally arcuate motion of the actuating lever in a manner hereinafter described causes the tabs to be dispensed, one at a time, at a location directly under the portion of the nail gun from which the nail issues.

The end of the roll of tabs is intended to travel along a channel 66 that is rigidly mounted in a lower interior part of the actuating lever 60. The channel 66 is visible in FIGS. 3 and 4, and FIGS. 5 and 6 reveal that the channel is mounted equidistant from the curved sides of the actuating lever 60.

It is desirable that the continuous roll of tabs stored in the cavity 36 move only in a single direction through the channel 66, which is assured by the utilization of an anti-reversing clip 41 discussed hereinafter in connection with FIGS. 9 and 10, which clip is effective to prevent the roll of tabs from moving at any time in a rearward direction through the channel 66.

Figure 7:
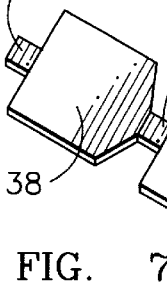
FIG. 7 is a fragmentary view of a pair of typical tabs of the type I prefer to use in my device, with this view revealing how a strip of plastic extends between each pair of the preformed tabs.

With particular reference to fragmentary FIG. 7, it will be noted that each adjacent pair of tabs 38 is interconnected by the previously mentioned relatively narrow strip 38*a,* with these strips being formed during the preferred molding procedure in which a large number of integrally interconnected identical tabs are created in a carefully spaced relationship out of the aforementioned industrial grade plastic material. The dispensing of tabs from my novel device in a carefully integrated relationship with the operation of the nail gun 14 will be discussed at length hereinafter.

As will shortly be explained in more detail, the tabs are intended to be engaged by fingers 72 contained on the underside of a tab engaging device 70, with latter device being clearly visible in FIGS. 3 through 6. The device 70 is caused to travel in a bidirectional manner adjacent parallel rails 90, which are located directly above the channel 66 and disposed in a parallel relationship therewith. The fingers 72 are to be seen in FIGS. 3 through 5, with these fingers serving to bring about movement of the roll of tabs through the channel 66 on a one-tab-at-a-time basis. It will be appreciated that the narrow strip 38*a* and the rounding or angling of the forward edge of each tab in the manner revealed in FIGS. 7 through 10 allows for the proper amount of space between tabs so that the fingers 72 of the tab-engaging device 70 can properly and fully engage each successive tab of the roll of tabs. The rounding or angling of the tabs helps decrease the backward pressure exerted on the tabs, but movement of the roll of tabs in the rearward direction through the lower part of the housing 12 is of course inhibited by utilization of the previously mentioned anti-reversing clip 41 depicted in FIGS. 9 and 10. The clip 41, held in place by a set screw 41*a,* is made from spring steel and positioned in such a manner that the clip is normally biased into contact with each next tab 38, in the manner depicted in FIG. 9. Undesirable movement of the roll of tabs in the reverse direction through the channel 66 is prevented by the clip moving into the position shown in FIG. 10, where it engages the flat backside of the illustrated tab.

Referring back to FIGS. 1 and 2, it is to be understood that the housing 12 also has front and rear portions, with the front portion 40 being intended to be removably attached to the aforementioned mounting component 28. As will be noted from FIGS. 1 and 2, lower holding pin 42 and upper holding pin 44 are slid into angled slots 29 provided on the mounting component 28. Although not visible in these figures, it is to be understood that pins virtually identical to pins 42 and 44 are utilized on the opposite side of the housing. Each of the upper holding pins 44 is threaded so as to be able to accept a threaded nut 46 of somewhat enlarged size that, when tightened, serves to hold the housing 12 in a firm operative relationship to the nail gun 14, but yet in a readily removable manner with respect to the nail gun.

With continued reference to FIGS. 1 through 4 it will be seen that on the rear portion 50 of the housing 12 I have shown an access cover 52, which is intended to afford ready access to the interior portion of the housing 12, in which the roll 37 of consistently spaced preformed tabs is contained in central cavity 36. The access cover 52 is preferably pivotally supported by a pair of pins 54, one pin on each side of the housing, with a latch 56 utilized at the top of the device in order to keep the cover 52 in the closed position except when a new roll of tabs is to be inserted into the cavity 36.

Returning to a further consideration of the previously mentioned actuating lever 60 of U-shaped cross section, this lever is supported in a hinged relationship to the housing 12 by the utilization of a pair of pivot pins 62, only one of which is visible in FIGS. 1 through 4. In other words, one of the pivot pins 62 is utilized on each side of the housing 12, adjacent the lower part of the rear portion 50 of the housing. The actuating lever 60 has sides with curved upper edges and it normally resides in the inactive position depicted in FIGS. 1 and 3. However, upon the operator bringing the lower surface of the actuating lever 60 into contact with the nailing surface 20, in the manner shown in FIG. 4, a tab is caused to be dispensed from the opening in the outer end of channel 66 in a manner described at some length hereinafter. I prefer to regard the raised position of the lever 60 depicted in FIGS. 2 and 4 as being the active position.

With reference to FIGS. 3 and 4, it is to be noted that the leading edge 61 of the actuating lever 60, clearly visible in FIG. 3, can move into substantial alignment with the front portion 40 of the housing 12 when the lever has been moved from its inactive position into the active or upper position illustrated in FIG. 4. In FIG. 4 it will be seen that a lower interior portion of the lever 60 moves into a recess provided in the lower member 34 of the housing member 12. This movement of the lever 60 into the position depicted in FIG. 4 takes place at such time as the user, by pushing down on the handle 26, causes the spring 31 (as well as a later-described spring 82 in the housing 12) to be overcome such that the lower interior portion of the lever 60 can come into contact with the lower portion 34 of the housing member as a consequence of the lower exterior portion of the lever 60 coming into firm contact with the nailing surface 20.

An arcuate slot 63 is provided on the outer surface of the lever 60 at a location spaced relatively close to the pivot pin 62, which slot is visible in FIGS. 1 and 2. A locking device 65, mounted on a threaded stud, is provided in order that the user may maintain the lever 60 in the raised position, such as during storage or transit, by tightening the locking device 65 into firm contact with the sidewall of the member 60.

It is to be noted that when the locking device 65 has been loosened, the actuating lever 60 normally remains in an inactive position in which the lower exterior surface 64 of the lever has pivoted away from the lower member 34 of the housing, in the manner shown in FIGS. 1 and 3. However, upon the lower exterior portion of the lever 60 being brought into contact with the surface 20 upon which nailing is to take place, it should now be clear that the actuating lever 60 rotates about the pivot pins 62 into the active position in which the lower interior portion of the lever 60 may be regarded as moving into a flush relationship with the lower member 34 of the housing 12. This upward motion of the lever 60 causes the dispensing of a tab 38 in the manner depicted in FIGS. 2 and 6, brought about by the functioning of the novel apparatus to be described shortly.

It has been previously mentioned that a central cavity 36 is defined in a mid portion of the housing 12, and from FIGS. 3 and 4 it will be noted that the roll 37 of preformed tabs is accommodated in this cavity. The end of this roll of preformed tabs is guided by the channel 66 mounted in the lower interior portion of the actuating lever 60 to an opening 69 clearly visible in FIG. 5, which opening is brought by upward movement of the actuating lever 60 into a location from which the end tab is to be dispensed at such time as the nail is to be driven through the tab by action of the nail gun 14.

Figure 5:
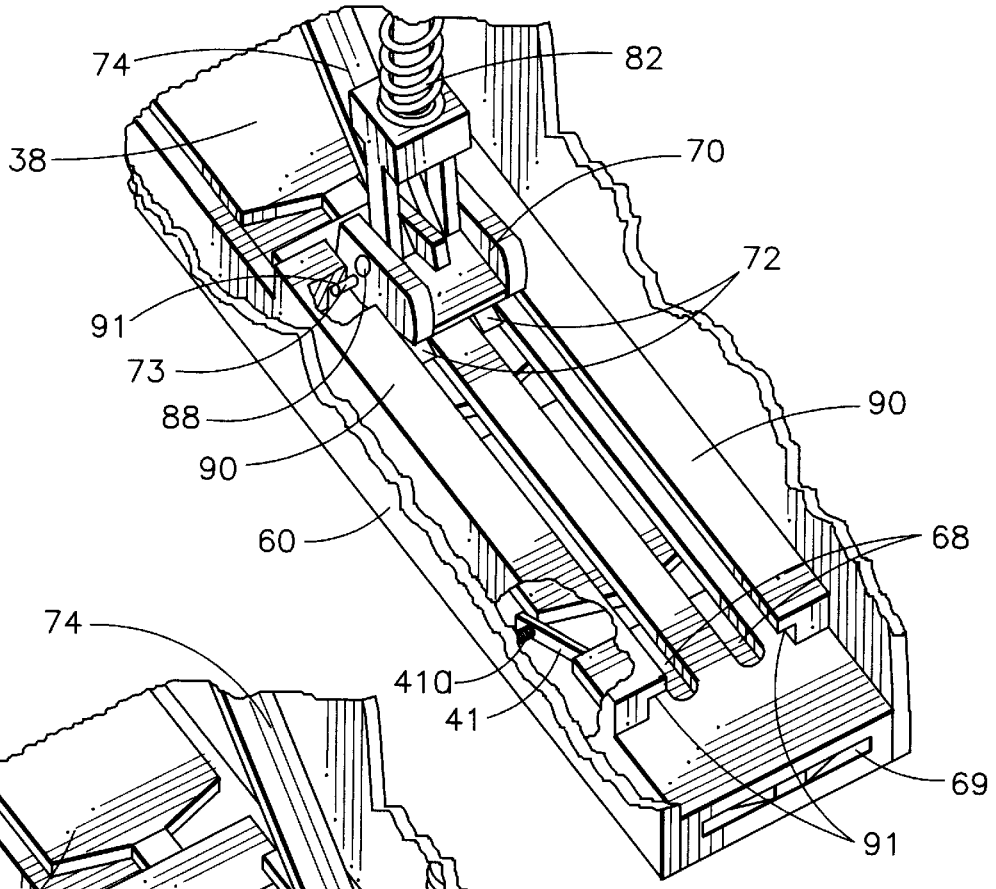
FIG. 5 is a fragmentary view to a comparatively large scale of certain details of the tab-carrying channel I utilize in the pivotally mounted actuating lever, with lever movements causing individual tabs to be selectively dispensed with each upward movement of the lever.
Figure 6:
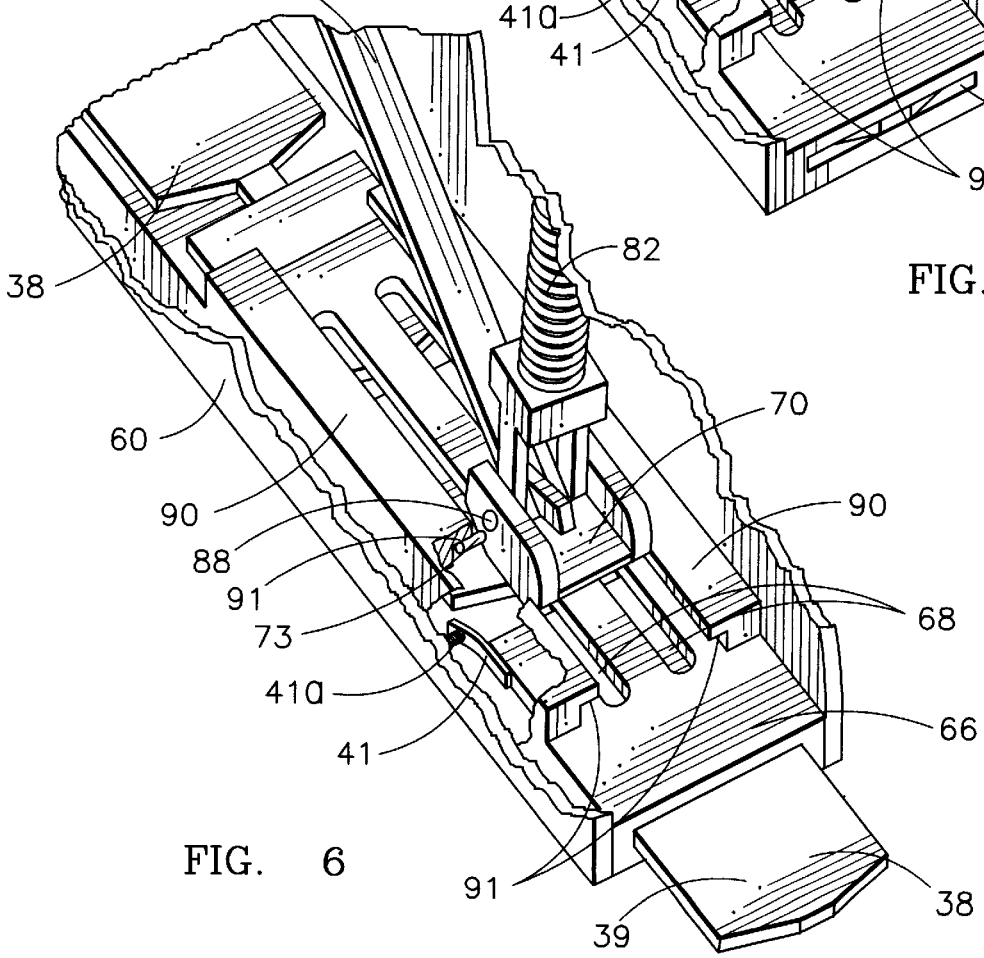
FIG. 6 is an enlarged fragmentary view quite similar to FIG. 5 but here depicting the emergence of a single tab from the channel provided for the transport of the tabs.

With further regard to FIGS. 5 and 6, it will be noted that the channel 66 defined along the lower interior portion of the actuating lever 60 is sized to permit the roll of tabs to pass easily therethrough in the dispensing direction. The preformed tabs are intended to move on a somewhat interrupted basis through the channel 66, and to be individually dispensed from the opening 69 in the manner shown in FIG. 6.

With reference to FIG. 4, it is to be understood that the tab at the outer end of the roll emerges from the leading edge 61 of the lever 60, with this outer tab being appropriately positioned to receive a nail 18 driven by the gun 14.

From the foregoing it should be obvious that a basic purpose of my device is to provide an arrangement by which one preformed tab 38 at a time will be dispensed from the roll 37 in response to upward movement of the actuating lever 60. The dispensed tab in each successive instance moves outwardly through the aforementioned opening 69 when the opening is effectively positioned under the portion of the nail gun 14 at which nailing is to occur. It is important to note that one of the advantageous features of my invention is the fact that no external power is required for the dispensing of tabs or discs from my tab insertion device in a properly timed relationship to the operation of the nail gun.

It should now be clear that in accordance with this invention, the motion of the lever 60, as it moves from the lowered or inactive position shown in FIG. 3 into the raised or active position depicted in FIG. 4, interacts in a highly advantageous manner with tab advancement means, which means serve to cause the tabs to move through the channel 66 in a somewhat interrupted or pulsed manner. To make this desired, non-continuous motion of the tabs possible, I provide a pair of slots 68 in the upper surface of the channel 66, which slots are best seen in FIGS. 5 and 6.

The previously mentioned tab-engaging device 70 is designed to travel closely adjacent the rails 90 defined on the upper surface of the channel 66, with this motion of the tab-engaging device taking place in response to movements of the actuating lever 60. The tab-engaging device 70 in concert with the rails 90 and the channel 66 are to be regarded as the tab advancement means forming an important part of my invention.

Disposed on the undersurface of the tab-engaging device 70 is the previously mentioned pair of fingers 72, with each of these fingers extending through a respective slot 68 defined in the upper surface of the channel 66, in the manner depicted in FIG. 5. These fingers are sufficiently widely separated as to span across the strip 38*a* and they are of sufficient length as to engage the straight shoulders provided on the rear edge of each individual tab 38 passing through the channel 66. As is obvious, the motion of these fingers in the forward direction brings about the non-continuous, somewhat interrupted forward motion of the tabs at a speed determined by the speed of upward movement of the actuating lever 60. It should now be clear that the fingers 72 of my novel tab advancement means cause the end tab of the roll of tabs to move outwardly through the opening 69 each time the lever 60 is caused to move from the lowered or inactive position shown in FIG. 3, into the raised or active position shown in FIG. 4. It should also be quite clear that tabs are dispensed on a one-at-a-time basis in accordance with my invention.

It is obviously necessary to prevent each of the fingers 72 provided on the underside of the tab-engaging device 70 from disengaging from its respective slot 68, so to that end I provide an engagement pin 73 on either side of the tab-engaging device 70. In addition, I provide a groove 91 on the underside of each of the rails 90, with these grooves being positioned so that the engagement pins 73 can travel therein as the device 70 moves adjacent the rails 90. The engagement pins act together to provide a pivot point for the tab-engaging device 70 on its return stroke and furthermore, they keep the tab-engaging device 70 operably attached to the rails 90 so that the fingers 72 will reliably remain in an operative relationship to the tabs 38 during the subsequent forward stroke.

It is to be observed from FIG. 3 that each of the downwardly protruding fingers 72 is of a pointed configuration. What may be regarded as the leading edges of the fingers 72 are comparatively straight, so that the fingers can reliably engage the relatively straight rear surface of each next tab during the forward stroke of the tab-engaging device 70. As previously mentioned, this motion is in response to the lever 60 moving from the position shown in FIG. 3 into the position shown in FIG. 4. On the other hand, the trailing edges of the fingers 72 are of angled configuration, so as to cause the tab-engaging device 70 to pivot upwardly, as shown in FIG. 3, at such time as it is moved in the retracting direction during the descent of the lever 60 back into the inactive position shown in FIG. 3.

Figure 9:
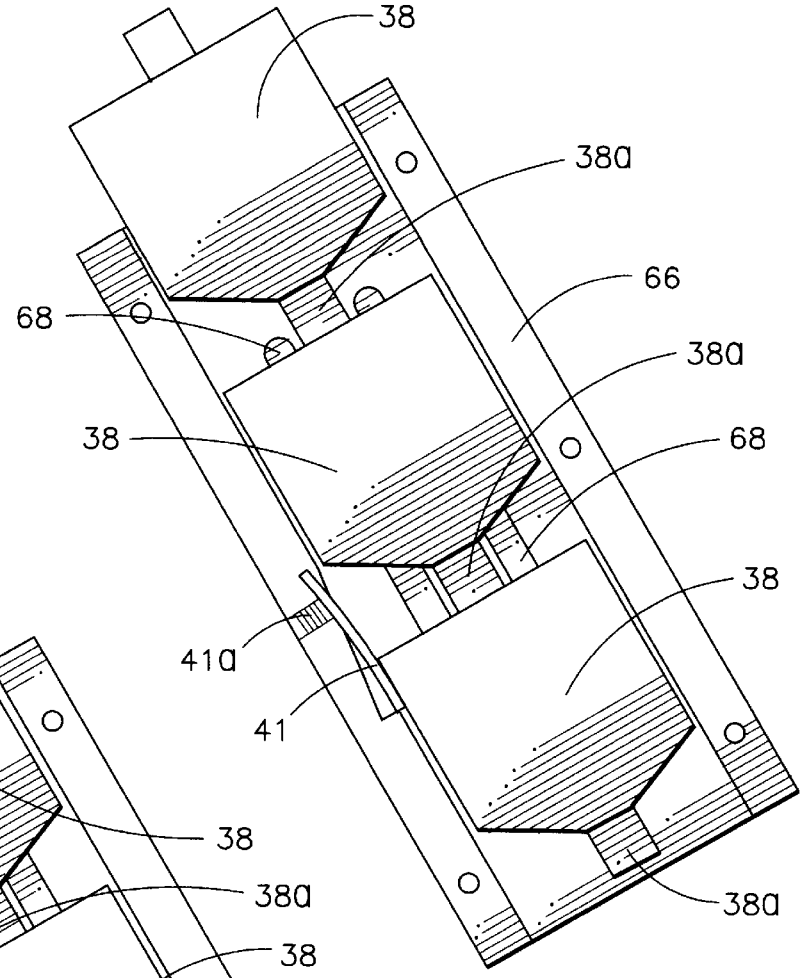
FIG. 9 is a fragmentary top view, to a somewhat larger scale, showing the path of travel of a plurality of tabs through the channel provided for the passage of the tabs.
Figure 10:
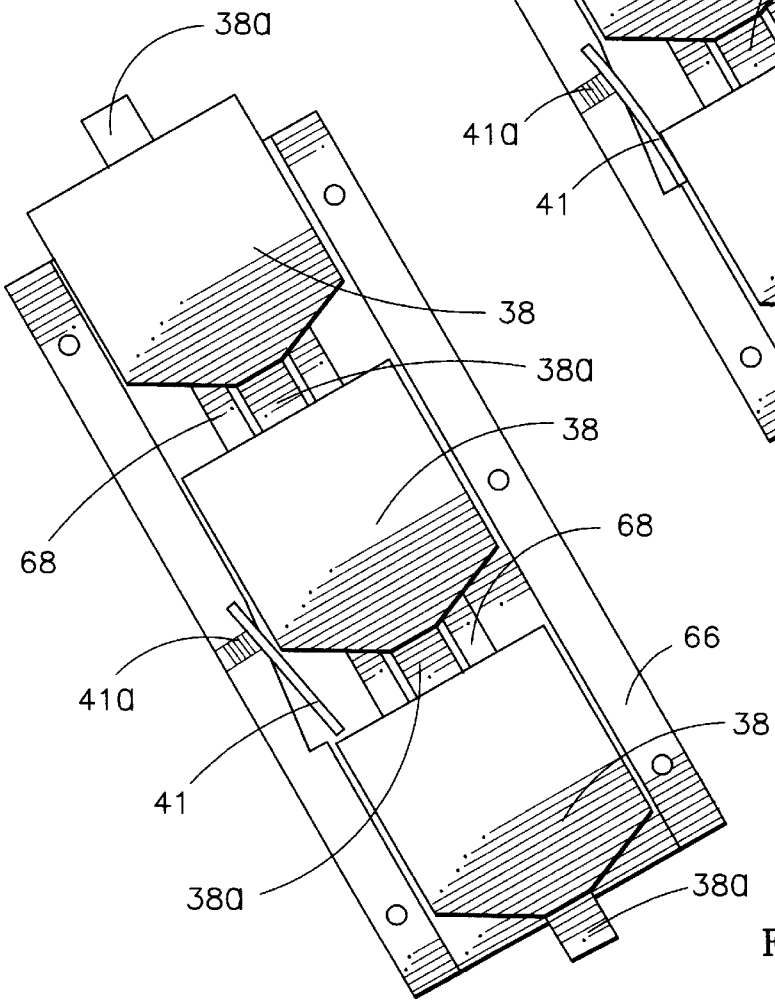
FIG. 10 is a view closely similar to FIG. 9 but showing the operation of an anti-reversing clip, which serves to prevent movement of the roll of tabs through the channel in the wrong direction.

It is to be noted that any tendency for the tabs to move backward in the channel 66 is overcome by the use of the anti-reversing clip 41, which of course has previously been mentioned as being illustrated in FIGS. 9 and 10. This clip, which typically is of spring steel, moves in behind advancing tabs to inhibit any tendency for backward movement.

With regard to the mounting of the tab-engaging device 70, it will be seen from FIGS. 3 and 6 to be pivotally affixed to the lower end of an elongate arm or support bar 74, and as will be noted from FIG. 3, the upper end of the support bar 74 is pivotally connected at 76 to the main body 78 of the tab dispensing portion of the housing. The main body 78 is configured in an enlarging manner at the location of the support bar 74 so as to provide sufficient freedom for this bar to rotate from the position shown in FIG. 3 to the position shown in FIG. 4 each time the lower exterior surface of the actuating lever 60 is pressed against the nailing surface 20.

From a study of FIGS. 3 and 4 it can be readily appreciated that as the lever 60 is caused by its underside 64 contacting the nailing surface 20 to move upwardly about pivot pins 62, the tab-engaging device 70 is caused to move adjacent the rails 90 disposed above the channel 66, with the fingers 72 on the underside of the tab-engaging device 70 being configured to reliably engage the strip of tabs, and to cause a desired unidirectional motion of the strip of tabs through the channel 66 on a tab-by-tab basis. It can therefore be seen that my novel device may be regarded as dispensing tabs semi-automatically in a manner readily adapted for use with a nail gun or staple gun.

With continuing reference to FIG. 3, it will be appreciated that it is highly desirable to keep the tab-engaging device 70 in firm operational contact with the upper surface of the channel 66 during upward rotation of the actuating lever 60, and to this end I provide a pressure applying member 80 principally involving a compression spring 82 of substantial length that surrounds a pair of members 84*a* and 84*b* disposed in a telescopically engaged manner. The upper end of the member 84*a* is pivotally mounted at 86 to the main body 78, and in a similar manner to that mentioned in connection with the arm 74, the main body is configured in an enlarging manner at the location of the member 84*a* so as to permit a swinging motion of the pressure applying member 80.

The lower end of the lower telescopic member 84*b* is pivotally attached at 88 to the tab-engaging device 70, with the compression spring 82 serving to help keep the device 70 in firm sliding contact with the upper surface of the channel 66 during motion of the lever 60 in the tab-dispensing direction. Because of the location of the pivotal attachment point 88, the force of the spring 82 does not prevent the fingers 72 on the undersurface of the tab-engaging device 70 from moving in a desirable manner out of contact with the tabs of the roll of tabs during the downward motion of the lever 60; note in this regard FIG. 3.

As is obvious, after a tab has been dispensed and the actuating lever removed from contact with the nailing surface 20, the lever 60 returns to the lowered position shown in FIG. 3 under the downward force asserted by the compression spring 82. It is to be noted that the force of the spring 82 is supplemented by the force of gravity when the tool is used in a horizontal mode.

It should now be obvious that as the outer end 39 of the roll of tabs emerges from the end of the channel 66 in the manner depicted in FIG. 4, it moves outwardly in an unsupported manner so as to extend below the active portion of the nail gun 14, which of course is the location at which nailing is to take place.

It has previously been mentioned that commercially available nail guns, such as the generic gun 14 depicted in the figures of drawing, are equipped with safety devices preventing the nailing action from being brought about until the user has pressed the lower portion of the gun safety device 22 of the nail gun firmly against the surface upon which nailing is to take place. With reference back to FIGS. 3 and 4, it will be recalled that the gun 14 is equipped with an upwardly slidable, generally "Z" shaped gun safety member 22 as well as a safety component 23 placed so as to be contacted with the upper end of the member 22. As a consequence of this arrangement, when the gun is not depressed (not in firing mode), the internal safety mechanism operatively associated with the trigger 27 prevents its operation. The previously mentioned compression spring 31 has its upper coil attached to the front end of the gun and its lower member attached to the safety member 22.

In the disabled mode depicted in FIG. 3, a nail will not expel upon depression of the trigger 27 because the safety 22 has not acted upon the upwardly slidable safety component 23 so as to bring about release of the internal safety mechanism of the gun.

In the enabled mode shown in FIG. 4, the spring 31 in the gun is depressed by the upward movement of the safety member 22, at which time the component 23 is moved upwardly in the manner depicted in FIG. 4 so as to make it possible for the gun to be fired by the operator pulling the trigger 27. As should appear obvious, upon the gun being moved away from the nailing surface 20, the spring 31 pushes the safety back into the disabled mode represented by FIG. 3.

Figure 11A:
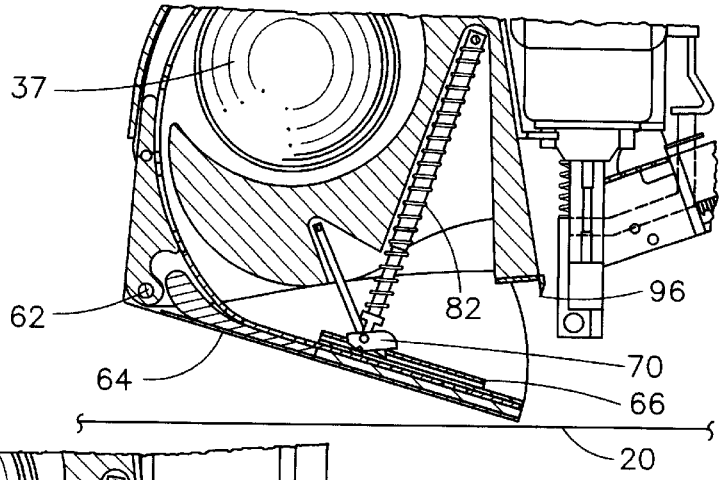
FIG. 11A is the first of several related views prepared to a relatively small scale and depicted in cross section so as to reveal the successive steps involved in dispensing preformed tabs, with FIG. 11A bearing a close relationship to FIG. 3.
Figure 11B:
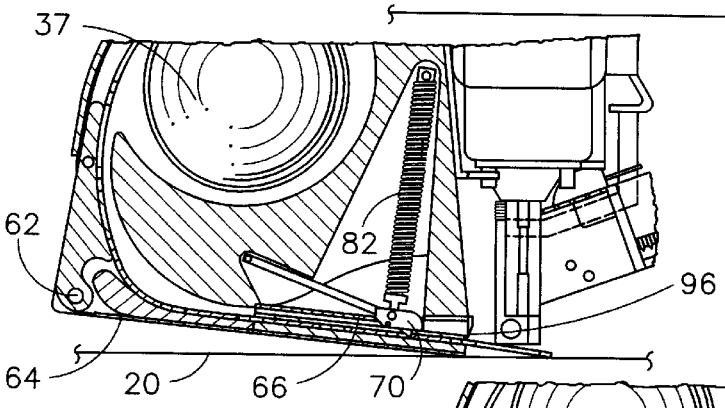
FIG. 11B is a second of several related views, with this cross sectional view illustrating how the lead tab from a roll of tabs is dispersed as a consequence of upward movement of the pivotally mounted actuating lever, with the lead tab here still attached to the roll of tabs.
Figure 11C:
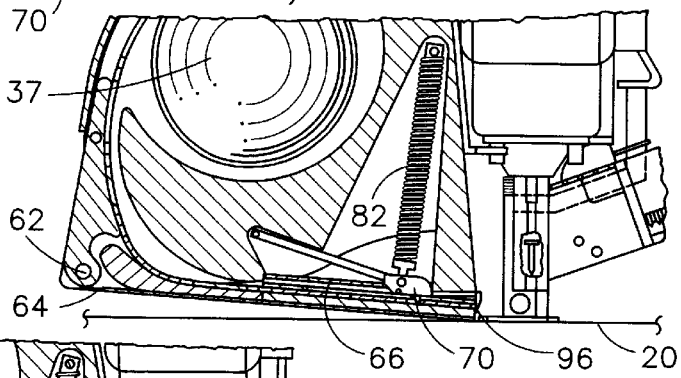
FIG. 11C is the third of several related views, with this view showing a completion of the upward movement of the pivotally mounted actuating lever, with this further upward movement of the lever having the effect of severing the lead tab so that it can receive a nail delivered by the nail gun.
Figure 11D:
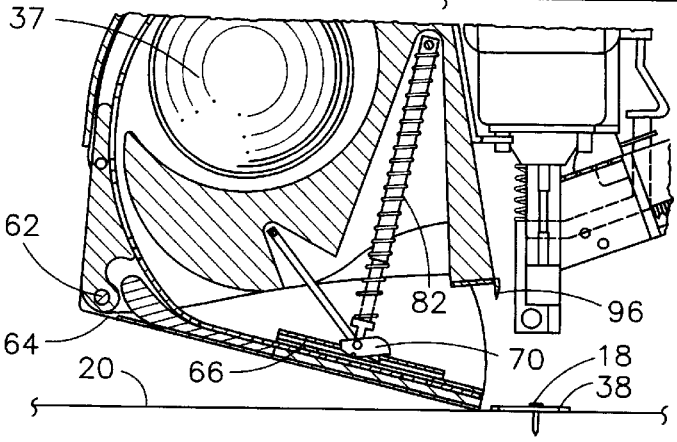
FIG. 11D is a view of the completed operation in which the pivotally mounted lever has returned to the appropriate inactive position depicted in FIG. 11A.

The overall operation of my device will be further clarified by reference to related FIGS. 11A through 11D, where the specific operational details are depicted. As the user places the device in a new position on the work surface 20, so as to bring the undersurface 64 of the lever 60 into contact with the surface 20, the lever 60 is caused to rotate upwardly from the inactive position shown in FIG. 11A, through the tab dispensing position depicted in FIG. 11B, and into the position depicted in FIG. 11C. When the lever 60 has reached the position depicted in FIG. 11C, in which the lever is in firm contact with the work surface 20, the safety mechanism of the nail gun 14 has been overcome so that the nail can be driven into the severed tab. FIG. 11D shows the severed tab having been penetrated by a nail dispensed from the nail gun.

As should now be clear, the upward movement of the actuating lever is of course against the bias of spring 82 of my novel device as well as against the bias of the previously-mentioned compression spring 31 of the nail gun. It should also be clear that this motion of the actuating lever causes the fingers 72 of the tab-engaging device 70 of the tab advancement means to slide along the upper surface of the channels 66 in such a manner as to cause a single tab to emerge from the opening 69 disposed adjacent the end of the channel 66.

Because the plastic of which the tabs are made is relatively tough material, it cannot ordinarily be expected that breakage would occur, at the time of tab dispersal, at a location where the strip 38*a* interconnects an adjacent pair of tabs. For this reason I provide in accordance with a preferred embodiment of this invention, cutting means 94 on a lower part of the front portion 40 of the housing 12. It was previously seen in FIG. 3 that the cutting means involve a sharp edge 96 that is carefully positioned so as to coincide with the leading edge 61 of the actuating lever 60, in the manner shown in FIG. 4, when the actuating lever moves upwardly with respect to the underside of the housing 12.

With reference back to FIG. 1C, it will be seen that because of this careful positioning of the sharp edge 96, the strip 38*a* bridging between two individual tabs 38 will be severed, and thus permit a single individual tab to be pierced by a nail 18 delivered by the gun 14, without the pierced tab remaining connected to the roll 37 of tabs.

From FIG. 11D it will be seen that the nail gun and my novel tab dispenser are being lifted away from the site at which the nail 18 has been driven into the separated tab 38.

Although not preferred, I may utilize an arrangement in which the strip members 38*a* are scored or perforated or else provided with a weakened portion so that it will not be mandatory to utilize the cutting device 94.

It is thus to be seen that I have provided a tab dispensing device of highly advantageous construction that requires no externally-supplied power; that in no way compromises the safety features of the nail gun or staple gun with which it may be operatively associated; and that semi-automatically dispenses a tab for utilization by the associated gun each time the device is placed in a new position on the surface upon which nailing is to take place.

I claim:

1. A device utilized in conjunction with an automatic nail gun for dispensing preformed tabs from a roll to a location adjacent where nailing occurs, said device comprising a housing having an upper portion, front and back portions, and a lower member, with said lower member being adapted to be brought into close proximity with a surface upon which nailing is to take place, said housing also having means for removably securing said housing in an operative relationship adjacent the automatic nail gun, a mid portion of said housing having an inner chamber in which a roll of preformed tabs is contained, with an opening disposed adjacent a location where said lower member joins said front portion of said housing, through which opening the end of the roll of tabs is to move under the portion of the adjacent nail gun at which nailing is to take place, an actuating lever rotatably mounted on said housing and operably connected with tab advancement means, said lever being movable so as to cause a controlled motion of the end of the roll of tabs such that a tab at the end of the roll is selectively moved through said opening to a location under the portion of the nail gun directly concerned with nailing.

2. The device utilized in conjunction with an automatic nail gun for dispensing preformed tabs from a roll as recited in claim 1 in which said actuating lever, when brought into contact with the surface upon which nailing is to take place, brings about the dispensing of a tab from the roll of tabs.

3. The device utilized in conjunction with an automatic nail gun for dispensing preformed tabs from a roll as recited in claim 1 in which cutting means are provided adjacent said opening for severing said one tab away from the roll of tabs, whereby when the nail gun has been operated, a nail will be driven through the severed tab and into the surface upon which nailing is to take place.

4. The device utilized in conjunction with an automatic nail gun for dispensing preformed tabs from a roll as recited in claim 1 in which a channel is provided through which tabs of said roll can pass through, said tab advancement means being operably associated with said channel.

5. The device utilized in conjunction with an automatic nail gun for dispensing preformed tabs from a roll as recited in claim 4 in which an anti-reversing clip is provided in said channel, with said anti-reversing clip designed as to prohibit the backward movement of said tabs in said channel.

6. A device utilized in conjunction with an automatic nail gun for dispensing preformed tabs from a roll to a location adjacent where nailing occurs, said device comprising a housing, said housing having an upper portion, front and back portions, and a lower member adapted to be brought into close proximity with a surface upon which nailing is to take place, said housing also having means for removably securing said housing in an operative relationship adjacent the automatic nail gun, a mid portion of said housing having an inner chamber in which a roll of preformed tabs is contained, with an opening disposed adjacent a location where said lower member joins said front portion of said housing, through which opening the end of the roll of tabs is to move under the portion of the adjacent nail gun at which nailing is to take place, an actuating lever rotatably mounted on said housing, with a lower component of said lever able to extend under said lower member of said housing, said lever being movable from an inactive position in which said lower component of said lever has pivoted away from said lower member, into an active position in which said lower component of said lever is substantially contiguous with said lower member, said lever being operably connected with tab advancement means such that movement of said lever from said inactive position into said active position causes a controlled motion of the end of the roll of tabs, with the result that one of said tabs at the end of the roll is moved through said opening to a location under the portion of the nail gun directly concerned with nailing.

7. The device utilized in conjunction with an automatic nail gun for dispensing preformed tabs from a roll as recited in claim 6 in which cutting means are provided adjacent said opening for severing said one tab away from the roll of tabs, whereby when the nail gun has been operated, a nail will be driven through the severed tab and into the surface upon which nailing is to take place.

8. The device utilized in conjunction with an automatic nail gun for dispensing preformed tabs from a roll as recited in claim 6 in which a channel is provided through which tabs of said roll can pass through, said tab advancement means being operably associated with said channel.

9. The device utilized in conjunction with an automatic nail gun, for dispensing preformed tabs from a roll as recited in claim 8 in which an anti-reversing clip is provided in an operative relationship in said channel, with said anti-reversing clip designed as to prohibit backward movement of tabs in said channel.

10. The device utilized in conjunction with an automatic nail gun, for dispensing preformed tabs from a roll as recited in claim 6 in which spring means are utilized for biasing said lever to the inactive position.

11. A device utilized in conjunction with an automatic nail gun, for dispensing preformed tabs from a roll to a location adjacent where nailing occurs, said device comprising a housing, said housing having an upper portion from which the device may be carried, and a lower member adapted to be brought into close proximity with a surface upon which nailing is to take place, said housing also having front and rear portions, with mounting means on said front portion for removable attachment to the automatic nail gun, an inner chamber located in a mid portion of said housing in which a roll of preformed tabs is contained, with an opening in said housing disposed adjacent a location where said lower member joins said front portion of said housing, through which opening the end of the roll of tabs is to move under a safety member utilized on the nail gun, an actuating lever rotatably mounted on a rear lower part of said housing, with a lower component of said lever able to extend under said lower member of said housing, said lever being movable from an inactive position in which said lower component of said lever has pivoted away from said lower member, into an active position in which said lower component of said lever is substantially contiguous with said lower member, said lever being operably connected with tab advancement means such that movement of said lever from said inactive position into said active position causes said tab advancement means to bring about a controlled motion of the end of the roll of tabs, such that one of said tabs at the end of the roll is moved through said opening to a location under the nail gun at which nailing is to take place.

12. The device utilized in conjunction with an automatic nail gun for dispensing preformed tabs from a roll as recited in claim 11 in which cutting means are provided adjacent said opening for severing said one tab away from the roll of tabs.

13. The device utilized in conjunction with an automatic nail gun for dispensing preformed tabs from a roll as recited in claim 12 in which said cutting means are provided on a lower front portion of said housing adjacent said opening, said cutting means becoming operational to sever the protruding tab at such time as said lever has moved into contact with the lower member of said housing.

14. The device utilized in conjunction with an automatic nail gun for dispensing preformed tabs from a roll as recited in claim 11 in which a channel is provided in said lower component of said lever, with said channel being of a dimension to permit tabs of said roll to pass through, said tab advancement means being operably associated with said channel.

15. The device utilized in conjunction with an automatic nail gun for dispensing preformed tabs from a roll as recited in claim 14 in which an anti-reversing clip is provided in the channel in said lower component of said lever, with said anti-reversing clip designed as to prohibit the backward movement of said tabs in said channel.

16. The device utilized in conjunction with an automatic nail gun, for dispensing preformed tabs from a roll as recited in claim 11 in which spring means are utilized for biasing said lever to the inactive position.

17. A method used to feed tabs to an automatic nail gun capable of expelling a fastener through the tab and into a surface upon which nailing is to take place, said method comprising the steps of: operably attaching a tab dispensing device into an operable relationship with a nail gun, in which tab dispensing device a chamber is defined, placing in said chamber a plurality of tabs connected edge to edge in a preformed strip that can be shaped into a form advantageous to the tab dispensing device, providing a tab channel in said device through which said strip of tabs can pass, moving the first tab from the end of the strip through said tab channel by tab advancement means to a position in the firing path of the gun, cutting the end tab from the tab strip by a cutting means, and holding the severed tab in position for a fastener expelled by the nail gun to penetrate the tab and the nailing surface.

18. The method used to feed tabs to an automatic nail gun as recited in claim 17 in which an actuating lever is operably attached to said tab advancement means, with movement of the nail gun with respect to a nailing surface to accomplish the driving of a nail causing the operation of said actuating lever and therefore the dispensing of a tab into a position to be penetrated by the nail.

19. The method used in conjunction with an automatic nail gun as recited in claim 17 in which a space is provided between tabs to enable the tab advancement means to engage and move the tab strip through the channel.

20. The method used in conjunction with the automatic nail gun as recited in claim 17 in which the rear edge of said tabs are shaped to allow an anti-reversing clip to engage the tabs and prevent backward movement of the strip of tabs.

* * * * *